US006840392B2

(12) United States Patent
Lamstein

(10) Patent No.: US 6,840,392 B2
(45) Date of Patent: Jan. 11, 2005

(54) BOOKLET SUPPORT AND DISPLAY DEVICE

(76) Inventor: Aaron Lamstein, 600 Main St., Sausalito, CA (US) 94965

( * ) Notice: Subject to any disclaimer, the term of this patent is extended or adjusted under 35 U.S.C. 154(b) by 89 days.

(21) Appl. No.: 10/371,881

(22) Filed: Feb. 20, 2003

(65) Prior Publication Data

US 2004/0164039 A1 Aug. 26, 2004

(51) Int. Cl.[7] ..... A47F 5/08

(52) U.S. Cl. ..... 211/113; 211/50; 211/118; 206/806

(58) Field of Search ..... 211/113, 115–119, 211/72, 73, 57.1, 59.1, 54.1, 51, 49.1, 50, 11; 281/50; 248/248, 317; 206/806, 482, 476, 479, 464; 220/476; 40/124.06, 642.01, 642.02, 649, 657, 661.06, 661.08, 672, 124, 124.2, 124.4, 611.13

(56) References Cited

U.S. PATENT DOCUMENTS

| | | | | | |
|---|---|---|---|---|---|
| 835,178 | A | * | 11/1906 | Clare | 40/124.4 |
| 2,242,736 | A | * | 5/1941 | Wilder et al. | 40/672 |
| 2,356,078 | A | * | 8/1944 | Myers | 118/500 |
| 2,811,280 | A | * | 10/1957 | Commisso et al. | 221/48 |
| 3,275,274 | A | * | 9/1966 | Hutcheon | 248/309.1 |
| 3,817,190 | A | * | 6/1974 | Evangelista | 108/44 |
| 3,841,478 | A | * | 10/1974 | Wells et al. | 206/495 |
| 3,985,232 | A | * | 10/1976 | Johnson | 206/461 |
| 4,422,552 | A | * | 12/1983 | Palmer et al. | 206/466 |
| 4,718,627 | A | * | 1/1988 | Fast et al. | 248/222.12 |
| 4,742,914 | A | * | 5/1988 | Klein | 206/461 |
| 4,771,890 | A | * | 9/1988 | Hofland et al. | 206/445 |
| 4,854,451 | A | * | 8/1989 | Jensen | 206/554 |
| 4,911,392 | A | * | 3/1990 | Fast | 248/220.31 |
| 4,948,267 | A | * | 8/1990 | Kaldenbaugh | 383/63 |
| 5,096,070 | A | * | 3/1992 | Jaynes | 211/85.15 |
| 5,097,961 | A | * | 3/1992 | Patino et al. | 211/10 |
| 5,103,845 | A | * | 4/1992 | Matthews | 132/73 |
| 5,242,062 | A | * | 9/1993 | Engravalle | 211/45 |
| 5,284,259 | A | * | 2/1994 | Conway et al. | 211/73 |
| 5,386,916 | A | * | 2/1995 | Valiulis | 211/113 |
| 5,553,721 | A | * | 9/1996 | Gebka | 211/59.1 |
| 5,987,791 | A | * | 11/1999 | Paine | 40/124.4 |
| 6,286,690 | B1 | * | 9/2001 | Thalenfeld | 211/113 |
| 2003/0150827 | A1 | * | 8/2003 | Blumreich et al. | 211/113 |

* cited by examiner

*Primary Examiner*—Carl D. Friedman
*Assistant Examiner*—Jennifer E. Novosad
(74) *Attorney, Agent, or Firm*—Dergosits & Noah LLP

(57) ABSTRACT

A combination device for supporting and displaying written works and the written works themselves. An elongated strip is provided having a longitudinal axis with a series for supporting and displaying the written works along the longitudinal axis. The device is capable of releasably capturing and displaying the written works such that each written work can be identified on the elongated strip and individually removed therefrom.

7 Claims, 3 Drawing Sheets

BOOKLET SUPPORT AND DISPLAY DEVICE

TECHNICAL FIELD

The present invention deals with the combination of a device for supporting and displaying multiple copies of written works such as booklets and brochures and the written works themselves which can be individually identified and removed from the display device without disturbing other written works supported thereon. The present invention is ideally suited to provide a consumer with a well positioned orderly display exhibiting multiple copies of the same or similar materials in the form of booklets or brochures wherein a sufficient surface of the front cover of these written materials are visible to enable a consumer to pick the appropriate item from the display device without disturbing adjacent materials.

BACKGROUND OF THE INVENTION

Providing low cost support and display devices for retail consumers has always provided challenges to the manufacturer of such devices. When displaying consumer products for retail distribution, the products must be presented in an attractive, orderly fashion with enough of the product visible to attract customer interest. In addition, suitable support and display devices must be capable of securely retaining product in its appropriate customer-attracting orientation while enabling the consumer to readily remove product from its support device simply and conveniently while not disturbing the display of adjacent products.

There have been many attempts to configure support and display devices for the myriad of products sold by retailers with mixed results. For example, virtually everyone who has shopped in a supermarket environment has seen vertically hanging metal racks containing friction clips for releasably retaining bagged products such as-potato chips and cookies. Although such racks are universally employed, they are not without their own set of drawbacks. For example, the retailer must expend a fair amount of effort in individually securing each bagged product to a separate friction clip generally at the top edge of the sealed bag. Because of the frictional engagement of the clip some bags can inadvertently drop from the rack when a clip has been extensively used and is no longer supplying sufficient friction to keep a bagged product in place. This often times happens when an adjacent product is pulled from the display rack thus disturbing all product hanging from the rack. On the other end of the spectrum, some clips tend to apply excessive frictional engagement to a bagged product making it difficult for a consumer to remove the product from the rack at time of purchase. In extreme situations, a purchaser may tug on a product either dislodging the entire rack from its supporting shelving or may give up and decide not to purchase the product.

In addition to the drawbacks described above, devices for supporting and displaying multiple products for retail sales have been designed without regard to presenting the consumer with a sufficient portion of the product's packaging as to attract the consumer and provide the consumer with enough information to enable one to make an enlightened purchasing decision. When vertically hanging racks with the above-described frictional clips are employed, each hanging bag obscures substantially all of the packaging on the bag which hangs beneath and behind it. Although this is not a particularly important issue when all product hanging on a single rack is of a single type, the problem of product identification and customer attraction become major issues when diverse product is hung and displayed from a single rack.

Finally, up to now, there has been little or no thought given to the integration of a support device to the visual customer-attracting layout of product being displayed for sale. Oftentimes, display racks are designed to retain products for sale where in actual use, some product obscures the packaging of another depriving customers of proper product display and thus inhibiting product sale.

It is an object of the present invention to provide a device for supporting and displaying retailed materials and, particularly, written works which are free from the drawbacks outlined above.

These and further objects will be more readily apparent when considering the following disclosure and appended claims.

SUMMARY OF THE INVENTION

A combination of a device for supporting and displaying written works and written works supported thereby, said device comprising an elongated strip having a longitudinal axis, a series of hooks along said longitudinal axis for releasably capturing and displaying geometrically substantially identical multiple copies of said written work, each copy having an opening configured in substantially the same location on each written work, said location being other than a geometric center of such work such that as each written work is displayed by said device, it is supported and hangs in an orientation with respect to said longitudinal axis substantially the same as all other written work supported thereby.

DETAILED DESCRIPTION OF THE INVENTION

Figure 1:
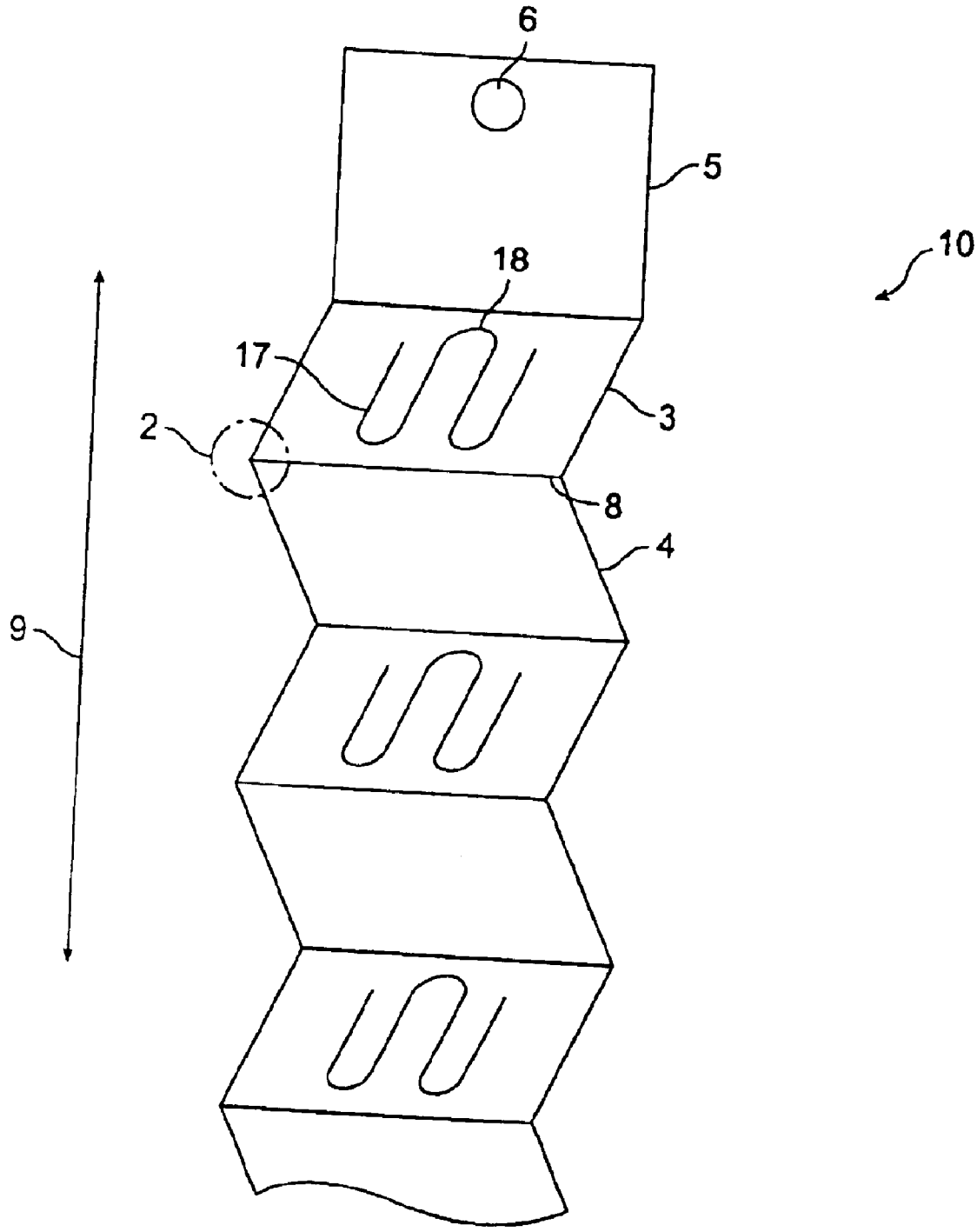
FIG. 1 is a prospective view of the device of a support before any written works are supported or displayed therefrom.

Reference is made to FIG. 1 which shows device 10 for supporting and displaying written works of the present invention for retail display. Device 10 is comprised of articulated subparts 3, 4, etc. which can emanate from anchor subpart 5. Anchor subpart 5 includes receiving orifice 6 which can be employed to receive any number of protruding support devices such as a peg bar hook for movably and releasably retaining device 10 in a predetermined advantageous location. In addition, a two dimensional advertisement attracting consumers to products supported by device 10 can be appended to anchor portion 5 by any suitable means such as by releasably stapling the advertising thereto.

Figure 2A:
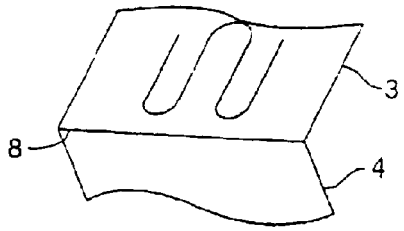
FIGS. 2*a* and 2*b* are prospective subparts of two embodiments of the support detailing the area identified as "2" of FIG. 1.
Figure 2B:
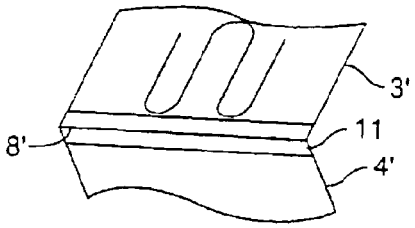

As noted, subparts 3, 4, etc. are articulated with respect to one another along hinge 8 which will be described in more detail with reference to FIGS. 2*a* and 2*b* below. The width of each articulated subpart defines the width of device 10 while the cumulative length of subparts 3, 4, etc. taken along longitudinal access 9 defines the overall length of device 10.

Subparts 3, 4, etc. are rotatable with respect to adjacent subparts. For example, adjacent subparts can be "hinged" by providing a living hinge 8 which is commonly used in configuring plastic parts, generally. Alternatively, subparts 3, 4, etc. can be articulated with respect to one another by configuring the subparts individually as subparts 3', 4', etc. and joining them at a common edge 8' through the use of a flexible member 11, such as a cloth tape.

As a preferred embodiment, device 10 can be configured from a single strip of plastic such as polypropylene or polyethylene which is scored between subparts 3, 4, etc. to produce living hinge 8. In addition, each subpart intended to support the written works of the present invention can be further scored as shown by score line 17. In doing so, a support in the form of hook 18 is provided for releasably capturing and displaying written works. This is not only an inexpensive and convenient way to produce device 10 but, in doing so, capturing hook 18 which is normally oriented within the plane of subpart 3 tends to releasably and reliably retain product to be displayed as, in doing so, element 18 is deformed from its "at rest" position thus causing a modest amount of frictional engagement with the written works displayed through the use of device 10.

Figure 3:
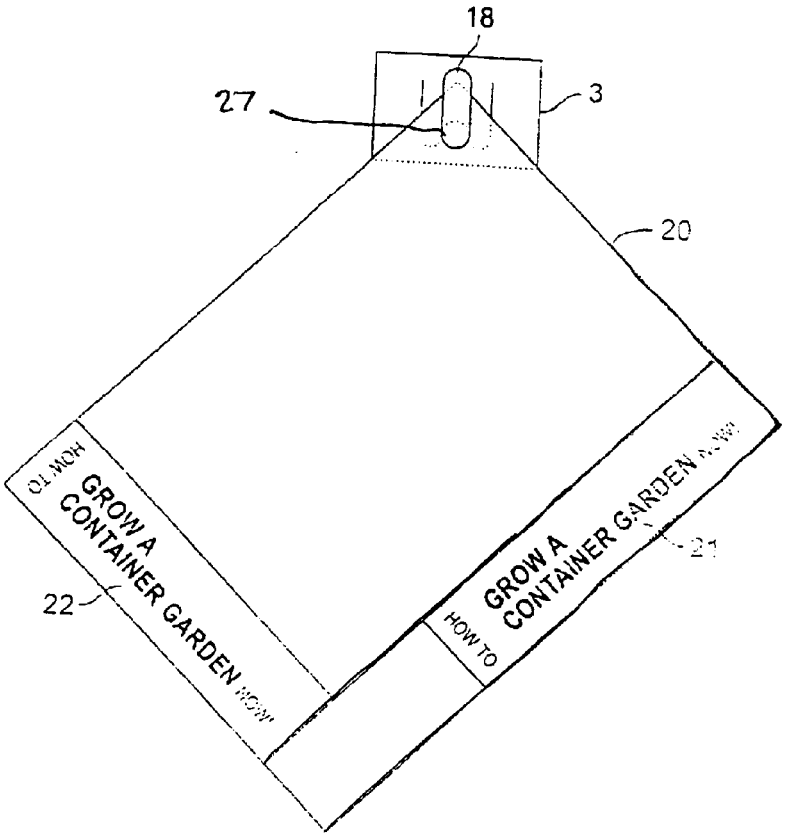
FIG. 3 is a detailed subpart of the present invention showing how a written work is intended to be supported and displayed from the device of FIG. 1.
Figure 4:
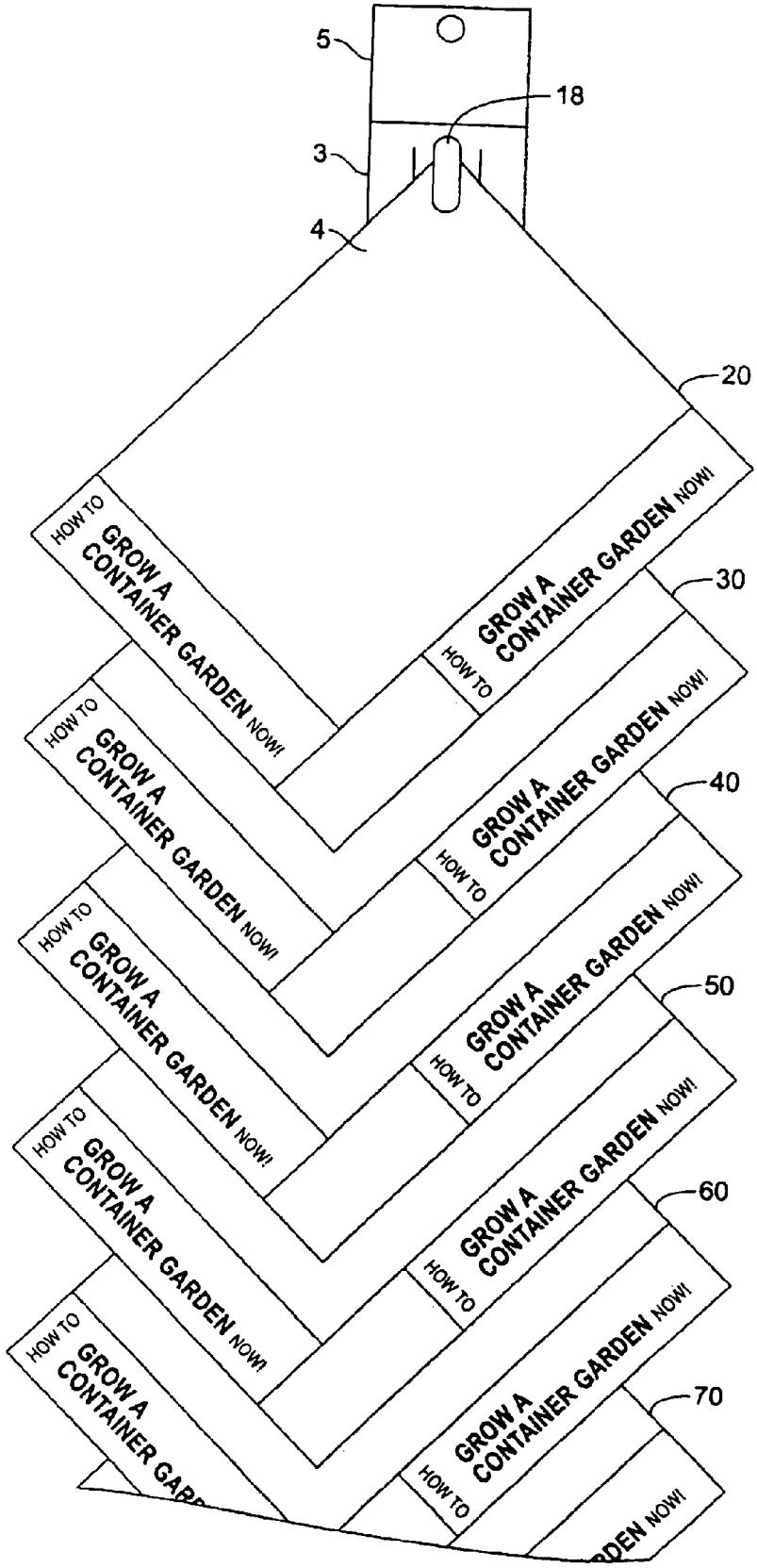
FIG. 4 is a side plan view of the present invention showing the combination device in operation.

The present invention is directed toward this combination of device 10 uniquely configured for the display of written works 20 (FIG. 3). Broadly, subparts such as subpart 3 is configured to provide a support for releasably capturing and displaying written work 20 such that each written work can be identified on the elongated strip and individually removed therefrom. This can best be appreciated in viewing FIG. 4.

The thrust of the present invention is that written work 20 be displayed and that multiple copies of written work 20 be supported by the device 10 such that each written work is substantially geometrically identical to all such written work releasably engaged thereby. Specifically, it is contemplated that hook 18 engage and capture each written work in the same location. In referring to FIGS. 3 and 4, hook 18 is shown to pass through opening 27 configured within written work 20. As noted by referring to the appended figures, preferably, written work 20 is substantially rectangular and each opening 27 is located other than that a geometric center of written work 20 and, specifically, proximate a corner thereof. As shown, ideally, opening 27 is configured in the upper left hand corner of the written work.

To further embellish upon the present invention, it is the combination of a device for supporting and displaying written works and the written works themselves that is of critical concern. In reference to FIG. 3, it is noted that when the written work comprises a booklet of written material such as element 20, the booklet is provided with a cover, a top, a bottom, a left edge and a right edge. The cover includes written identifying indicia 21 and 22 such as "How to grow a container garden" on at least two edges of the cover, preferably on the right hand edge and bottom portion thereof. When stacking and releasably retaining multiple copies of written work 20, 30, 40, 50, 60, 70 and so on, upon device 10, the hanging orientation of booklet 20 as provided by the positioning of opening 27 and the spacing between articulated subparts 3, 4, etc. is such that at least written indicia 21 and 22 of, for example, "How to grow a container garden" is visible to the retail purchaser. This is a critical feature of the present invention for it enables a prospective purchaser to observe and read identifying and product attracting information regarding a particular written work without the need to remove article 20 from the support and display device 10.

As noted, although the present invention has been extensively described regarding the orientation of written work 20 with regard to the overall invention, it is contemplated that other commercial products, traditionally sold at retail, could be supported and releasably displayed through the practice of the present invention. For example, instead of employing written work 20, a blister pack of a product, such as glue could be displayed with a suitable cardboard backing in providing the overall rectangular orientation as discussed above with regard to written work 20. The same attracting and informational indicia shown as elements 20 and 21 (FIG. 3) could be displayed on the referenced cardboard backing to provide a retail purchaser with the same point of purchase information as described previously with regard to written work 20.

The foregoing description has been limited to a specific embodiment of the invention. It is apparent, however, that variations and modifications can be made to the invention, with the attainment of some or all of the advantages of the invention. Therefore, it is the object of the appended claims to cover all such variations and modifications as come within the true spirit and scope of the invention.

I claim:

1. A combination of a device for supporting and displaying written works and written works supported thereby, said device comprising an elongated strip having a longitudinal axis, a series of hooks along said longitudinal axis for releasably capturing and displaying geometrically substantially identical multiple copies of said written works, each copy having a longitudinal axis and an opening configured in substantially the same location on each written work, proximate a corner thereof such that as each written work is displayed by said device, the written work is supported and hangs in a slanted orientation with respect to said longitudinal axis substantially the same as all other written work supported thereby such that the longitudinal axis of each written work is disposed at a non-parallel angle relative to the longitudinal axis of the strip and further wherein each copy of said written works is provided with identifying indicia located on said written works such that each copy can be identified when being supported by said device.

2. The combination of claim 1 wherein said corner is the upper left hand corner.

3. The combination of claim 1 wherein said written work comprises a series of booklets, each booklet of written work having a cover, said cover having a top, a bottom, a left edge and a right edge, said cover including written identifying indicia on at least two edges thereof, said identifying indicia positioned on said cover such that said identifying indicia is visible on each cover as said series of booklets are releasably supported by said device.

4. The combination of claim 3 wherein said identifying indicia is provided on at least said bottom and right edge of said cover.

5. The combination of claim 1 wherein said elongated strip comprises a series of articulated subparts, each articulated subpart being appended to adjacent subparts by hinges.

6. The combination of claim 5 wherein said hinges are living hinges.

7. The combination of claim 5 wherein said hinges are comprised of cloth tape.

* * * * *